US006505950B1

(12) United States Patent
Natoli et al.

(10) Patent No.: US 6,505,950 B1
(45) Date of Patent: Jan. 14, 2003

(54) LIGHTED NEWEL POST

(76) Inventors: Dale C. Natoli, P.O. Box 34, Defiance, MO (US) 63341; Paul Burr, 321 Chestnut La., Pyatt, AR (US) 72672

( * ) Notice: Subject to any disclaimer, the term of this patent is extended or adjusted under 35 U.S.C. 154(b) by 0 days.

(21) Appl. No.: 09/715,777

(22) Filed: Nov. 17, 2000

(51) Int. Cl.[7] ..... F21S 8/00

(52) U.S. Cl. ..... 362/146; 362/431; 362/251; 362/227; 256/10

(58) Field of Search ..... 362/431, 145, 362/146, 152, 276, 802, 251, 227, 20; 256/10, 1

(56) References Cited

U.S. PATENT DOCUMENTS 2,026,385 A * 12/1935 Heyde ..... 177/377
4,367,517 A 1/1983 Balzer
4,394,714 A 7/1983 Rote
4,841,416 A * 6/1989 Doss ..... 362/183
4,920,467 A * 4/1990 Honsberger ..... 362/226
5,161,874 A * 11/1992 Benes ..... 362/32
5,701,236 A 12/1997 Viviano

* cited by examiner

*Primary Examiner*—Sandra O'Shea
*Assistant Examiner*—Bertrand Zeade
(74) *Attorney, Agent, or Firm*—Polster, Lieder, Woodruff & Lucchesi, L.C.

(57) ABSTRACT

A newel post system contains a light emitting source, such as a halogen and/or fluorescent bulb, for example. The system includes a newel post with a central bore for installing the light source and openings which permit the light to be emitted external of the newel post. The light source preferably is connected to a conventional electric power grid, and, in the preferred embodiment includes a transformer and a sensor that closes to provide power to the light emitting source when the sensor senses some predetermined condition. The light source may also be connected to a power source via an emergency power supply unit whereby the emergency power supply unit provides power to the light bulb when the power ceases to be delivered to the emergency power supply unit.

19 Claims, 4 Drawing Sheets

LIGHTED NEWEL POST

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to safety lighting, and more particularly to a lighting system for walkways and stairways including a lighted newel post.

People have always moved about their homes and other buildings requiring artificial light for guidance. Often times, such as in the middle of the night, people will move about homes and avoid turning on bright lights. Other times, people must move about in a house when the power to home has been cut, for instance, by a storm.

Broadly speaking, the problem for the person walking through a poorly-lit home or building is safety. The person is interested in making sure they do not walk into walls or furniture, step or trip on something, such as a sleeping pet or a child's toy, or trip or fall down a stairway. Moreover, any solution to the problem must be esthetically pleasing as to fit in with the decor of the home or building.

Turning on a light in the middle of the night can bring discomfort to one whose eyes already are adjusted to a low-level light condition. In addition, the light may disturb others who are sleeping. Furthermore, as one passes from room to room, the switch for a light may not be conveniently located. For these, and many other reasons, it is desirable for lights to switch on and off so that one may find their way in the night without turning on bright lights.

In some cases, rheostats have been used to allow for a low-level light. However, these have the disadvantage of causing a user to locate the switch on a wall or, as is often the case with rheostats, locating a knob. In other cases, what are termed nightlights are used. These have the disadvantage of always being turned on. Alternatively, unless coupled with an ambient light sensor, they must be turned on and off each night. This increases energy bills and requires light bulbs to be replaced frequently.

When the power to the home has been cut or disconnected, one must find alternate sources of lighting. Typically, people will fumble about looking for a flashlight or for candles. During this time, one is particular prone to an accident. In some instances, the building or home may have emergency lighting that turns on from a stored battery source when an outlet source loses power. These lights are excellent when a structure needs to be evacuated, such as in fire or other. However, these work for their intended purpose because they typically brightly lit. If evacuation is not one's goal, the high-level illumination is often unnecessary and undesirable.

The safety problem in particularly acute with stairs and walkways. In the home, stairways often are decorative in nature, and safety lighting is difficult to install properly.

The prior art reveals a number of attempts to provide safety lighting. While these structures work for their intended purposes, they are difficult to install, both initially and as a retrofid installation.

BRIEF SUMMARY OF THE INVENTION

Among the several objects of the present invention is an improved safety lighting system that is esthetically pleasing and overcomes the problems of the previously mentioned lighting fixtures.

Another object of this invention is to provide a decorative newel post having a self contain light source.

Another object of this invention is to provide a light system for a newel post having changeable light shades.

Yet another object of this invention is to provide a newel post adaptable to either interior or exterior use.

Still another object of this invention is to provide a newel post system which may be either hard wired or connected removably to a conventional electrical supply source.

Another object of this invention is to provide a newel post system having an emergency back up power supply.

Other objects will be apparent to those skilled in the art in light of the following description of the preferred embodiment.

In accordance with the invention, generally stated, a newel post system comprising a light bulb located within the newel post, and a plurality of openings for the light to be emit external to the newel post is disclosed. The low voltage bulbs are powered by a step down transformer that is connected to a conventional 110V power source. In addition, the bulbs are connected to an emergency power source that is activated when conventional power is lost. Lastly, a sensor is incorporated into the system. The sensor may sense movement or may sense a lack of light. In other words, the sensor may cause the light to be turned on when it recognizes a moving body or person that may require light, or may cause the light to be turned on when it recognizes no light is present, i.e., at dusk. Other objects and other features will in part be apparent and in part pointed out hereinafter.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 1:
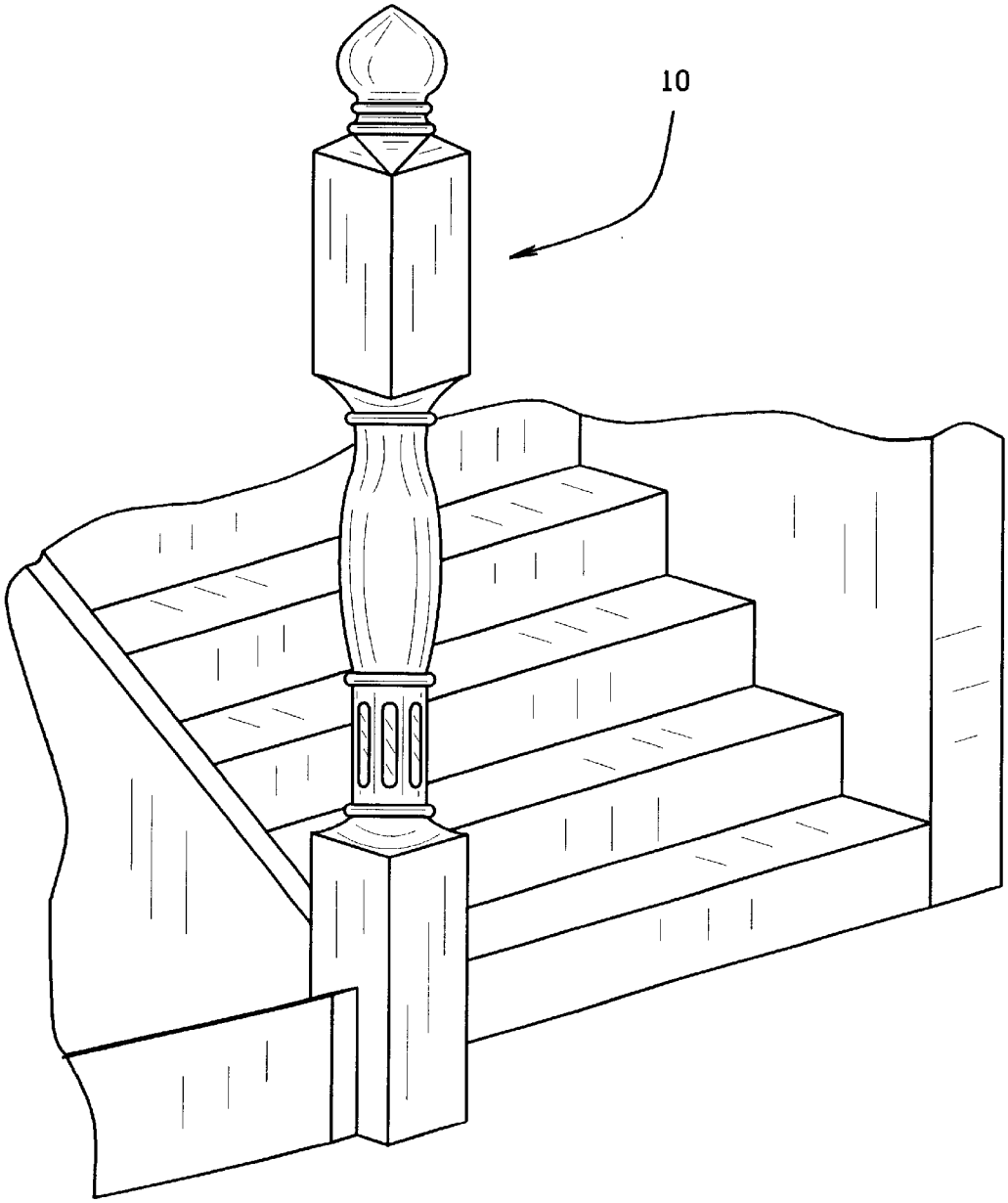
FIG. 1 is a perspective view of one illustrative embodiment of the newel post system of the present invention.

Referring initially to FIG. 1, a newel post system 10 of the present invention is depicted. As shown, the newel post system 10 may be affixed or mounted as a part of a conventional stairway, for example. As will be appreciated by those skilled in the art, the system 10 is intended for either or both interior and exterior use. In the embodiment of FIG. 1 the newel post system 10 is shown mounted to a stair case, and the configuration depicted in FIG. 1 is intended to be illustrative of the various mounting configurations of the system 10.

Figure 2:
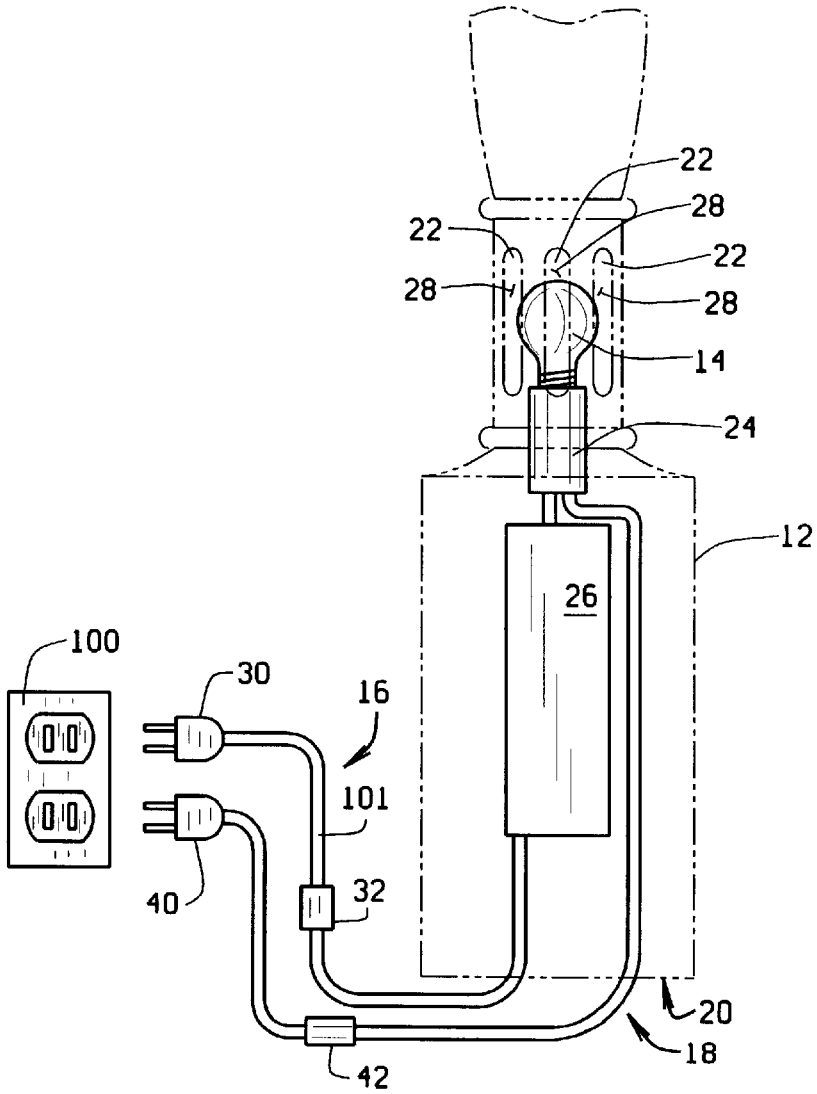
FIG. 2 is a elevational view of the newel post system of FIG. 1 with the newel post shown in phantom.

Referring now to FIG. 2, details of one illustrative embodiment of the newel post system 10 of the present invention are depicted. The newel post system 10 includes a newel post 12, a emitting light source 14 such as a light bulb 14*a*, a first circuit path 16 and a second circuit path 18. The newel post 12 is a conventional newel post as is known in the art, except that the post 12 has a central bore 20, preferably through the center of the newel post 12 and extending upwardly from the bottom of the newel post 12 to a predetermined height. The central bore 20 is large enough to accommodate the light bulb 14*a* and to allow for and contain the first and second circuit paths 16 and 18.

The light bulb 14*a* is mounted in that portion of the central bore 20 that is both decorative and effective from a safety consideration.

As will be appreciated the light source 14 may comprise any of a variety of devices. A low voltage halogen bulb, an incandescent bulb and/or a flourescent bulb, for example, all are compatible with the broader aspect of the invention. The central bore 20 communicates with a plurality of decorative, radially aligned openings 22 formed in the newel post 12. The openings 22 allow light from the light bulb 14*a* to be emitted externally of the newel post 12. The light bulb 14*a* may be supported by a light fixture 24, and is operatively connected to a transformer 26 in the embodiment of FIG. 1.

The openings 22 may be covered by a light shade 28, either transparent or translucent, located within the newel post 12, if desired. The light shade 28 is intended to be a decorative feature. For example, the shade 28 may have some color imparted to it. Thus, the shade 28 may be green, red or other color scheme to match the surrounding decor, provide a holiday theme, or alter the ambiance of the surrounding area.

The first circuit path 16 comprises an electrical plug 30 that is the termination for a conventional two or three wire line 101 (hot, return and ground) which connects the system 10 to a 110V electrical system. The line 101 is connected to a device 32 in a conventional manner, and the device or sensor 32 in turn is connected to the transformer 26. Again, sensor 32 may be any one of a number of electrical components for connecting the voltage source to the transformer 26 and bulb 14*a*. For example, sensor 32 may comprise a photoelectric eye, a manual or electrically operated switch, or a conventional timer in various applications of the system 10, and all such devices are intended to be encompassed the term sensor. The transformer 26 preferably is a step down construction that provides low voltage to the light bulb 14*a*. Preferably, the light bulb 14*a* is chosen to maximize the illumination for the size of the light bulb 14*a*. The transformer 26 may be located in a variety of locations. For example, the transformer 26 may be located within the central bore 20, while the plug 30 is located outside of the newel post 12. The device 32 may be located inside or outside the newel post 12.

The second circuit path 18 comprises an electrical plug 40 that is the termination for a conventional two or three wire line, which connects to the wall outlet 100, preferably a conventional 110V electrical system. The second circuit path 18 provides a power supply for the bulb 14 in an emergency. That is, the second circuit path 18 supplies direct power to the light bulb 14 when the power to the wall outlet is cut or is lost. This turns the light bulb 14 on when an emergency is present. The plug 40 connects to an emergency power supply unit 42 via a power cord, the emergency power supply unit 42 being in turn connected to the light bulb 14 via a power cord. The emergency power supply unit 42 contains a battery and delivers 12VDC of electricity. The emergency power supply unit 42 and plug 40 preferably are located remotely with respect to the newel post 12.

Figure 3:
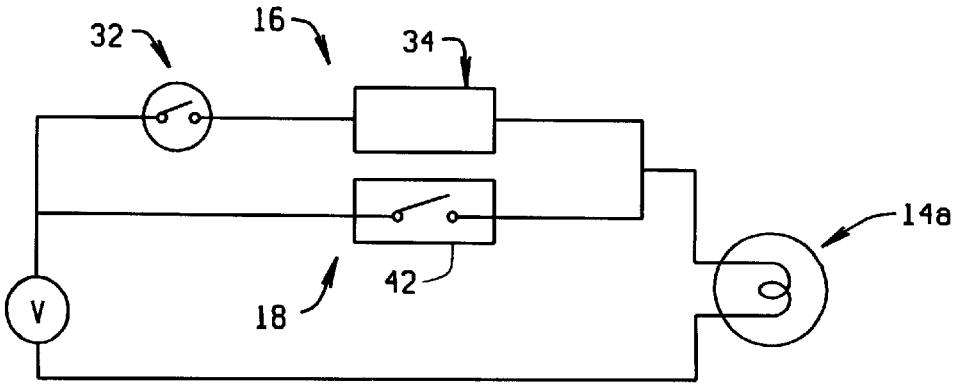
FIG. 3 is a diagram of one illustrative embodiment of the electrical circuit usable with the newel post system of the present invention.

Referring now to FIG. 3, a schematic of the electrical items of the newel post system 10 shown in FIGS. 1 and 2 are depicted. As can be seen, there is a 110V alternating current power source V, i.e. a wall outlet. The first and second circuit paths 16 and 18 are in parallel, each connecting to the light bulb 14*a*. However, each only operates upon the occurrence of the predetermined situations discussed above.

Figure 4:
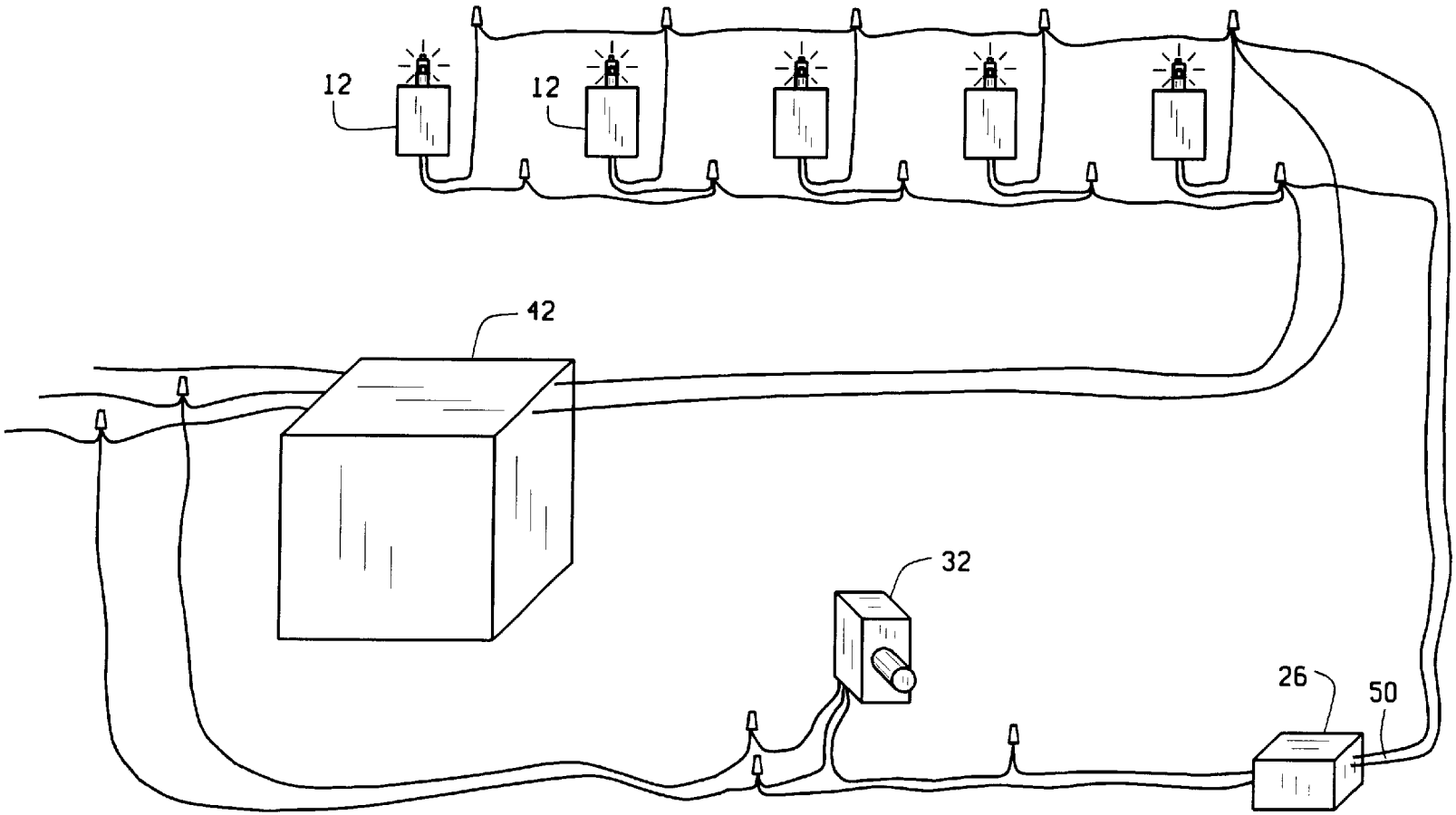
FIG. 4 is a block diagram view of a second illustrative embodiment of the newel post system of this invention.
Figure 5:
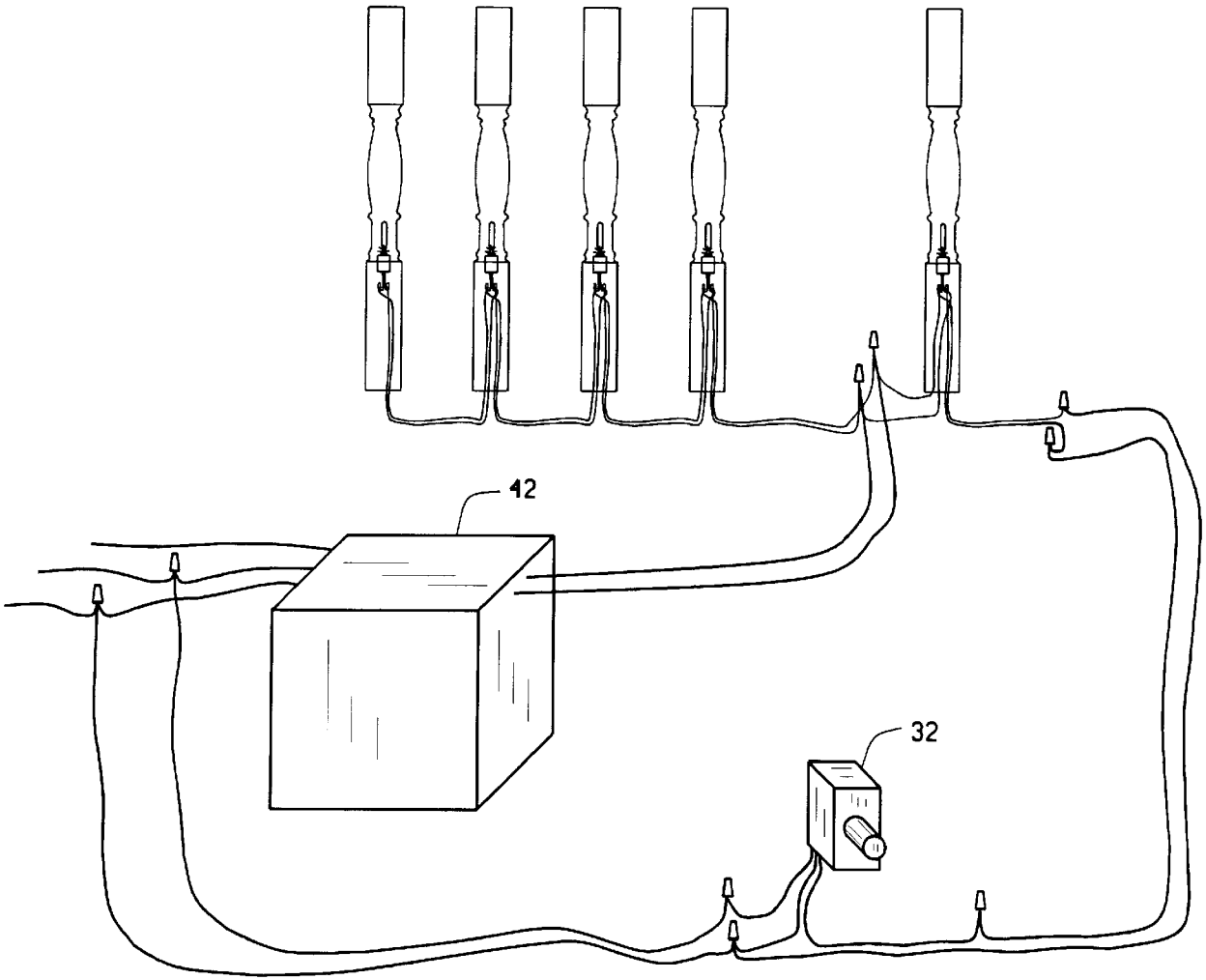
FIG. 5 is a block view of a variation of the newel post system shown in FIG. 4.

FIGS. 4 and 5 depict hard wired embodiments of our invention. As shown in FIG. 4, a series of newel post 12 are provided, which are connected in parallel from an output side 50 of the transformer 26. We have found up to five of the newel post 12 can be operated from a single transformer 26. Even in the emergency situation, the battery backup 42 operates each of the newel posts 12 in parallel with one another.

FIG. 5 illustrates an alternative configuration in which the transformer 26 is mounted within an initial power newel post, and the remaining posts are connected in series with the power newel post. When battery backup occurs, however, the power newel post is operated in parallel with the newel posts, which remain in series connection. Other electrical arrangement will occur to those skilled in the art. In any event, the configuration of FIGS. 4 and 5 are directly wired to a source of electrical energy, as opposed to the plug in arrangement described in connection with FIG. 2.

While the invention preferably is incorporated in new construction, those skilled in the art will recognize that the newel post and associated circuit components may be provided in kit form for retro fit application. The circuit components may be mounted on the underside of the stairs for example, and the wire run along the strike plate of the stairs. Other mounting arrangements are compatible with the broader aspects of the invention.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A newel post system for a banister positioned adjacent a stairway comprising:

a light emitting source;

a newel post with a base, said newel post being mounted at said base, said light emitting source located therein, said newel post and including at least one opening permitting said light emitting source to provide illumination external to said newel post along said stairway, said newel post having an upper portion having a decorative design, said newel post functioning as part of the banister; and a low volting power source providing electricity to said light emitting source.

2. The newel post system of claim 1 wherein said light emitting source is a light bulb.

3. The newel post system of claim 2 wherein said light bulb is a high intensity light bulb.

4. The newel post system of claim 1 further comprising a first circuit path electrically connecting said light emitting source to a power source.

5. The newel post system of claim 4 wherein said first circuit path further includes a sensor between said power source and said light source.

6. The newel post system of claim 5 wherein said first circuit path further includes a low-voltage transformer connected between said sensor and said light emitting source.

7. The new post of claim 6 wherein said source is a photoelectric eye.

8. The newel post system of claim 6 further comprising a second circuit path electrically connecting said light emitting source to an emergency power supply unit such that the emergency power supply unit delivers power to said light source when the power source ceases delivering power to said emergency power supply unit.

9. The newel post system of claim 1 wherein said newel post includes an central bore from the bottom of said newel post to a predetermined height.

10. The newel post system of claim 9 further comprising:

a first circuit path including a power cord, a plug connected to said power cord and said power source there between wherein said power source is an alternating-current wall outlet, a photoelectric eye connected to said plug and power cord, and a low-voltage transformer connected via said power cord between said photoelectric eye and said light bulb; and a second circuit path including a second power cord, a second plug connected thereto and connected to said power source wherein said power source is an alternating-current wall outlet, and an emergency power supply unit connected to said second power cord and connected to said light bulb such that the emergency power supply unit delivers power to said light bulb when the power source ceases delivering power to said emergency power supply unit.

11. A newel post system for a banister positioned adjacent a stairway comprising:

a newel post having a base, said newel post being mounted at said base, said newel post including an axial opening extending at least partially through the newel post, and at least one opening permitting radial communication to said axial opening, said newel post forming a part of the banister;

a light emitting source mounted in said newel post, said light emitting source being positioned near said last recited opening to provide illumination externally of said newel post;

a shade positioned about said light emitting source; and a low voltage power source for providing power to said light emitting source, said power source including a first circuit path electrically connecting said light emitting source to a source of electrical energy, a second circuit path electrically connecting said light emitting source to an emergency power supply unit; and at least one sensor for operating said light from one of said first circuit path and said second circuit path.

12. The system of claim 11 wherein said newel post system comprises a plurality of newel posts.

13. The system of claim 12 wherein said newel post plurality are connected in parallel with one another.

14. The newel post system of claim 12 wherein said newel post plurality are connected in series with one another when operated in conjunction with said first circuit path and are connected in a series-parallel relationship when operated in conjunction with said second circuit path.

15. The newel post system of claim 12 wherein said first circuit path further includes a transformer electrically connected between said electrical power source and said light emitting source.

16. The newel post system of claim 15 wherein said transformer is mounted within said newel post.

17. The newel post system of claim 16 wherein said first and second circuit paths further include an electrical plug for connecting the first and second electrical circuits to said power source.

18. The newel post system of claim 17 wherein said sensor is a switch.

19. A newel post system for a banister positioned adjacent a stairway, comprising:

a light emitting source;

a newel post including a base, said newel post being mounted at said base, the newel post including a body section having an opening extending axially at least partially there through, and a plurality of radially extending openings communicating with said axial opening at a predetermined location along said axial opening, said light emitting source emitting light through said radially extending openings so as to provide illumination along said stairway, said newel post forming a portion of said banister;

a first circuit path electrically connecting said light emitting source to a power source;

a second circuit path connecting said light emitting source to an emergency power supply unit;

an emergency power supply unit operatively connected to said second circuit path; and a sensor for connecting said light emitting sensor to one of said first and second circuit paths.

* * * * *